US007889092B2

(12) United States Patent
Volk et al.

(10) Patent No.: US 7,889,092 B2
(45) Date of Patent: Feb. 15, 2011

(54) ALERT DEVICE HAVING NOTIFICATION-BASED CUSTOMIZABLE SETTINGS

(75) Inventors: Jason Adam Volk, North Bethesda, MD (US); Blake Andrew Robertson, Reisterstown, MD (US)

(73) Assignee: Alertus Technologies, Beltsville, MD (US)

( * ) Notice: Subject to any disclaimer, the term of this patent is extended or adjusted under 35 U.S.C. 154(b) by 251 days.

(21) Appl. No.: 12/324,833

(22) Filed: Nov. 26, 2008

(65) Prior Publication Data

US 2009/0174566 A1 Jul. 9, 2009

Related U.S. Application Data

(60) Provisional application No. 60/990,607, filed on Nov. 27, 2007, provisional application No. 60/990,614, filed on Nov. 27, 2007.

(51) Int. Cl.
*G08B 3/00* (2006.01)

(52) U.S. Cl. ..... 340/691.5; 340/332; 340/691.1; 340/691.6; 340/693.5; 340/326; 340/331

(58) Field of Classification Search ..... 340/333, 340/691.1, 691.6, 693.5, 825.36, 326, 331
See application file for complete search history.

(56) References Cited

U.S. PATENT DOCUMENTS 4,074,244 A 2/1978 Balderson
4,155,042 A 5/1979 Permut et al.
5,121,430 A 6/1992 Ganzer et al.
5,289,162 A * 2/1994 McDaniel ..... 340/521
5,296,840 A * 3/1994 Gieffers ..... 340/474
5,451,930 A * 9/1995 McDaniel ..... 340/521
5,566,339 A * 10/1996 Perholtz et al. ..... 713/340
5,572,201 A 11/1996 Graham et al.
5,574,999 A 11/1996 Gropper
5,781,852 A 7/1998 Gropper
5,986,561 A 11/1999 Kuruvilla et al.
6,177,873 B1 1/2001 Cragun
6,295,001 B1 9/2001 Barber
6,411,201 B1 6/2002 Hur et al.
6,411,207 B2 6/2002 Shaffer
6,462,665 B1 10/2002 Tarlton et al.
6,553,215 B1 4/2003 Chung (Continued)

FOREIGN PATENT DOCUMENTS

EP 0736851 A2 9/1996

(Continued)

*Primary Examiner*—Daryl Pope

(57) ABSTRACT

An alert device is disclosed. The alert device has at least one light, at least one speaker, and a communication system configured to receive an alert notification containing instructions for each of at least one pattern and duration of activation of the at least one light, at least one pattern and duration of activation of the at least one speaker, and an overall duration of the alert notification. The alert device further has a controller communicatively coupled with the at least one light, the at least one speaker, and the communication system. The controller is configured to monitor the communication system for the alert notification, decode the alert notification, activate the at least one light and the at least one speaker for their respective at least one patterns and durations of activation, and deactivate the at least one light and the at least one speaker after the overall duration elapses.

26 Claims, 4 Drawing Sheets

U.S. PATENT DOCUMENTS

| | | | | |
|---|---|---|---|---|
| 6,617,964 | B1 | 9/2003 | Lamb | |
| 6,710,715 | B2 | 3/2004 | Deeds | |
| 6,867,688 | B2 | 3/2005 | Lamb | |
| D503,644 | S | 4/2005 | Case et al. | |
| 6,927,673 | B2 | 8/2005 | Right et al. | |
| 7,053,753 | B2 | 5/2006 | Kacalek et al. | |
| 7,212,111 | B2 | 5/2007 | Tupler et | |
| 7,230,546 | B1 * | 6/2007 | Nelson et al. | 340/933 |
| 2004/0034689 | A1 | 2/2004 | Kacalek et al. | |
| 2004/0200403 | A1 | 10/2004 | O'Shaughnessy et al. | |
| 2005/0090291 | A1 | 4/2005 | Stolzenthaler, III | |
| 2006/0022819 | A1 | 2/2006 | Granny et al. | |
| 2007/0075844 | A1 | 4/2007 | Taylor | |

FOREIGN PATENT DOCUMENTS

| | | | |
|---|---|---|---|
| WO | 2006085781 | A1 | 8/2006 |
| WO | 2007046800 | A1 | 4/2007 |

* cited by examiner

ALERT DEVICE HAVING NOTIFICATION-BASED CUSTOMIZABLE SETTINGS

This application claims the benefit under 35 U.S.C. §119 (e) of U.S. Provisional Application No. 60/990,607 entitled "System and Method for Controllably Distributing Alert Notifications" and U.S. Provisional Application No. 60/990,614 entitled "Alert Device Having Event-Driven Customizable Settings," both filed Nov. 27, 2007.

TECHNICAL FIELD

The present disclosure is directed to an alert device and, more particularly, to an alert device having notification-based customizable settings and a method for controlling the alert device.

BACKGROUND

Alert devices exist in a variety of settings to inform people of emergency conditions, weather conditions, and any other information relevant to the users of the alert device. These alert devices typically include visible and/or audible alert components that are activated in response to a particular event (i.e., a received signal such as an alert notification). For example, a typical smoke detector sounds a loud alarm when it receives a signal from a sensor, the signal indicating that smoke from a fire may be detected at or around the smoke detector. In another example, a typical fire alarm sounds a loud alarm and activates a bright strobe light when it receives a signal from a fire detection network indicating that someone has triggered another fire alarm within the network. In yet another example, a typical weather radio receiver plays an alarm tone and displays a message on a text display when it receives a radio signal on a frequency reserved for emergency weather alerts. The latter two examples above depict alert devices connected to receive alert signals from remote sources, either through a wired communications channel (i.e., in the example of the fire alarm) or through a wireless communications channel (i.e., in the example of the weather radio receiver).

Alert devices typically function to alert people of a particular type of situation. Accordingly, they are configured to emit sounds and activate lights at intensities and patterns appropriate to their function. Continuing the above example of the fire alarm, the fire alarm activates bright lights and a loud siren to inform people that a potentially life-threatening situation (i.e., a fire) exists. Upon hearing the siren and/or seeing the lights, people are trained to know that they should seek safety by staying low to avoid smoke inhalation and trying to evacuate. The response of people to the fire alarm, however, would not be appropriate in all emergency situations. That is, the fire alarm, if used to indicate an emergency situation other than a fire may result in confusion, panic, injury, or death. For example, if the fire alarm were to be activated when a tornado is approaching, people evacuating in response to the alert would be potentially putting themselves in a life-threatening situation, rather than avoiding one. Thus, for safety reasons, the fire alarm in the above example is useful only to alert people of a potential fire. As discussed above, many different types of alert situations can be indicated by different alert devices. It would be inefficient and impractical, however, to administer separate alert devices for each type of alert situation.

In order to efficiently and effectively convey alerts of differing types, an alert device capable of customizing its visible and/or audible outputs based on a received alert signal is needed. One alert device that changes its alerting technique based on alert messages that it receives is disclosed in U.S. Pat. No. 6,867,688 (the '688 patent) issued to Lamb on Mar. 15, 2005. The '688 patent discloses an alert device having a receiver for receiving digital messages from a transmission tower providing cellular, PCS, or wireless telecommunications, a microcomputer with a monitoring circuit that monitors received digital messages, a liquid crystal display (LCD), a high-level audio speaker, a low-level audio speaker, a high-intensity strobe light, and a low-intensity light emitting diode (LED). The monitoring circuit monitors a digital control channel via the receiver until an alert message is received. When an alert message is received, the monitoring circuit decodes the alert message, which includes an 8-bit alert code and a text message string. The alert code indicates a level of severity of the alert message. Based on the alert code, the microcomputer chooses either a high-level alarm routine or a low-level alarm routine, each of which is preloaded in a non-volatile program memory of the microcomputer. More specifically, if the alert code equals five, then it indicates a "Level One" alert and the alert device executes the high-level alarm routine. If the alert code equals six, then it indicates a "Level Two" alert and the alert device executes the low-level alarm routine. The high-level alarm routine produces a high-decibel level tone on the high-level audio speaker, flashes the high-intensity strobe light, and displays the text message string on the LCD. In contrast, the low-level alarm routine produces a low-decibel level tone on the low-level audio speaker, flashes the low-intensity LED, and displays the text message string on the LCD. Both alert routines continue to run for a pre-determined amount of time or until a reset button is pressed, whichever occurs first. By executing one of the two alarm routines based on the alert code of a given alert message, the alert device of the '688 patent can provide a different alerting technique for alert messages having different alert codes corresponding to different severities. In particular, the high-level alarm routine is executed when the alert code indicates the existence of an emergency situation, while the low-level alarm routine is executed when the alert code indicates the possibility of an emergency situation. The device also provides the ability to signal the activation of an external device in response to the alert level. That is, if the alert level exceeds a level programmed on or stored by the alert device, the alert device signals the activation of the external device.

While the alert device of the '688 patent may choose one of two different alert techniques, each stored in the alert device's non-volatile memory, its application may be limited. More specifically, because the alert device of the '688 patent has only two pre-defined alert techniques corresponding to an alert code of each received alert message, the alert device may lack sufficient flexibility for the wide variety of emergency and non-emergency situations presented to organizations with large campuses. That is, because the two alert techniques are directly correlated to a severity (i.e., alert level) of the alert message, the alert techniques cannot be modified for a given emergency or non-emergency situation. In order to change the alert techniques (i.e., the type and duration of visible and audible alerts, and/or the duration of the displayed message text), the alert device may have to be reprogrammed by a professional, which could be inconvenient, costly, and/or impractical.

The alert device of the '688 patent may be further limited by the inflexibility of the alert routines it employs. More specifically, because the alert device of the '688 patent may employ exactly one audible alerting action (i.e., activating the high-level alarm in a static way or activating the low-level alarm in a static way) and exactly one visible alerting action (i.e., activating the high-intensity strobe light in a static way or activating the low-intensity LED in a static way) in response to each received alert message, it may not be operable to both attract the attention of a group of people and effectively convey information about the indicated alert situation. For example, while the high-level alarm routine is executed, the high-decibel level tone on the high-level audio speaker and high-intensity strobe light may deter or inhibit people from approaching the alert device to read the text message string. That is, people may not be effectively notified of the type of emergency situation, actions that should be taken, etc.

The alert device of the '688 patent may be further still limited by its style of interoperability with other devices. More specifically, while the alert device of the '688 patent may interface with external devices, the decision to activate a given external device is made by the alert device based on the alert level of a received alert message. As a result, a dispatcher of an alert message cannot choose to activate specific external devices on a case-by-case basis. That is, the external device is activated in response to a metric of the alert message (i.e., the alert level) rather than an instruction included in the alert message. It may be desirable for a particular external device to be activated for some alert messages of a given severity, but not for others of the same severity. For example, the external device may be a loud speaker connected to play a recorded message instructing people to evacuate a building. While it may be desirable to activate the recorded message in the event of a fire, it may be undesirable to activate the recorded message in the event of a tornado, since evacuation during a tornado would potentially put people in harm's way. However, the alert message sent in the event of the fire and the alert message sent in the event of the tornado may both have the same alert level (i.e., "Level One").

The alert device of the '688 patent may be further yet limited by its method of deactivation. More specifically, because the chosen alert routine may be executed until the first of a pre-determined amount of time elapsing or someone pressing a reset button, the alert routine may end prematurely or not last as long as the dispatcher desires. That is, the pre-determined amount of time may be too short for some alert situations (i.e., a dangerous hurricane condition that persists longer than the pre-determined amount of time), while the reset button may be pressed by anyone with physical access to the device, thus ending the alert routine prematurely. In the case of a dangerous hurricane condition, ending the alert routine prematurely may cause some people to miss the alert entirely, again potentially putting people in harm's way.

The alert device and method of the present disclosure are directed to overcoming one or more of the problems set forth above.

SUMMARY OF THE DISCLOSURE

One aspect of the present disclosure is directed to an alert device. In one embodiment, the alert device includes at least one light configured to controllably activate and deactivate, and at least one speaker configured to controllably activate and deactivate. The alert device also includes a communication system having at least one receiver configured to receive an alert notification containing at least digitally encoded instructions for at least one pattern and duration of activation of the at least one light, digitally encoded instructions for at least one pattern and duration of activation of the at least one speaker, and digitally encoded instructions for an overall duration of the alert notification. The alert device further includes a controller communicatively coupled with the at least one light, the at least one speaker, and the communication system. The controller is configured to monitor the communication system for the alert notification, and decode the alert notification to determine the at least one pattern and duration of activation of the at least one light, the at least one pattern and duration of activation of the at least one speaker, and the overall duration of the alert notification. The controller is also configured to activate the at least one light for the at least one pattern and duration of activation of the at least one light, activate the at least one speaker for the at least one pattern and duration of activation of the at least one speaker, and deactivate the at least one light and the at least one speaker after the overall duration of the alert notification substantially elapses.

Another aspect of the present disclosure is directed to a method of controlling an alert device having at least one light and at least one speaker. The method includes receiving an alert notification including instructions for at least one pattern and duration of activation of the at least one light, instructions for at least one pattern and duration of activation of that at least one speaker, and instructions for an overall duration of the alert notification. The method also includes decoding the alert notification to determine the at least one pattern and duration of activation of the at least one light, the at least one pattern and duration of activation of the at least one speaker, and the overall duration of the alert notification. The method further includes activating the at least one light for the at least one pattern and duration of activation of the at least one light, activating the at least one speaker for the at least one pattern and duration of activation of the at least one speaker, and deactivating the at least one light and the at least one speaker after the overall duration of the alert notification substantially elapses.

Yet another aspect of the present disclosure is directed to an alert device. The alert device includes at least one light configured to controllably activate and deactivate, and at least one speaker configured to controllably activate and deactivate. The alert device also includes a communication system having at least one receiver configured to receive an alert notification, and a controller communicatively coupled with the at least one light, the at least one speaker, and the communication system. The controller is configured to monitor the communication system for the alert notification. The controller is also configured to activate the at least one light according to a first pattern of activation of the at least one light for at least a first duration of activation of the at least one light, and activate the at least one light according to a second pattern of activation of the at least one light for at least a second duration of activation of the at least one light. The controller is further configured to activate the at least one speaker according to a first pattern of activation of the at least one speaker for at least a first duration of activation of the at least one speaker, and activate the at least one speaker according to a second pattern of activation of the at least one speaker for at least a second duration of activation of the at least one speaker.

Still another aspect of the present disclosure is directed to a method of controlling an alert device having at least one light and at least one speaker. The method includes receiving an alert notification. The method also includes activating the at least one light according to a first pattern of activation of the at least one light for at least a first duration of activation of the at least one light, and activating the at least one light according to a second pattern of activation of the at least one light for at least a second duration of activation of the at least one light. The method further includes activating the at least one speaker according to a first pattern of activation of the at least one speaker for at least a first duration of activation of the at least one speaker, and activating the at least one speaker according to a second pattern of activation of the at least one speaker for at least a second duration of activation of the at least one speaker.

DETAILED DESCRIPTION

Figure 1:
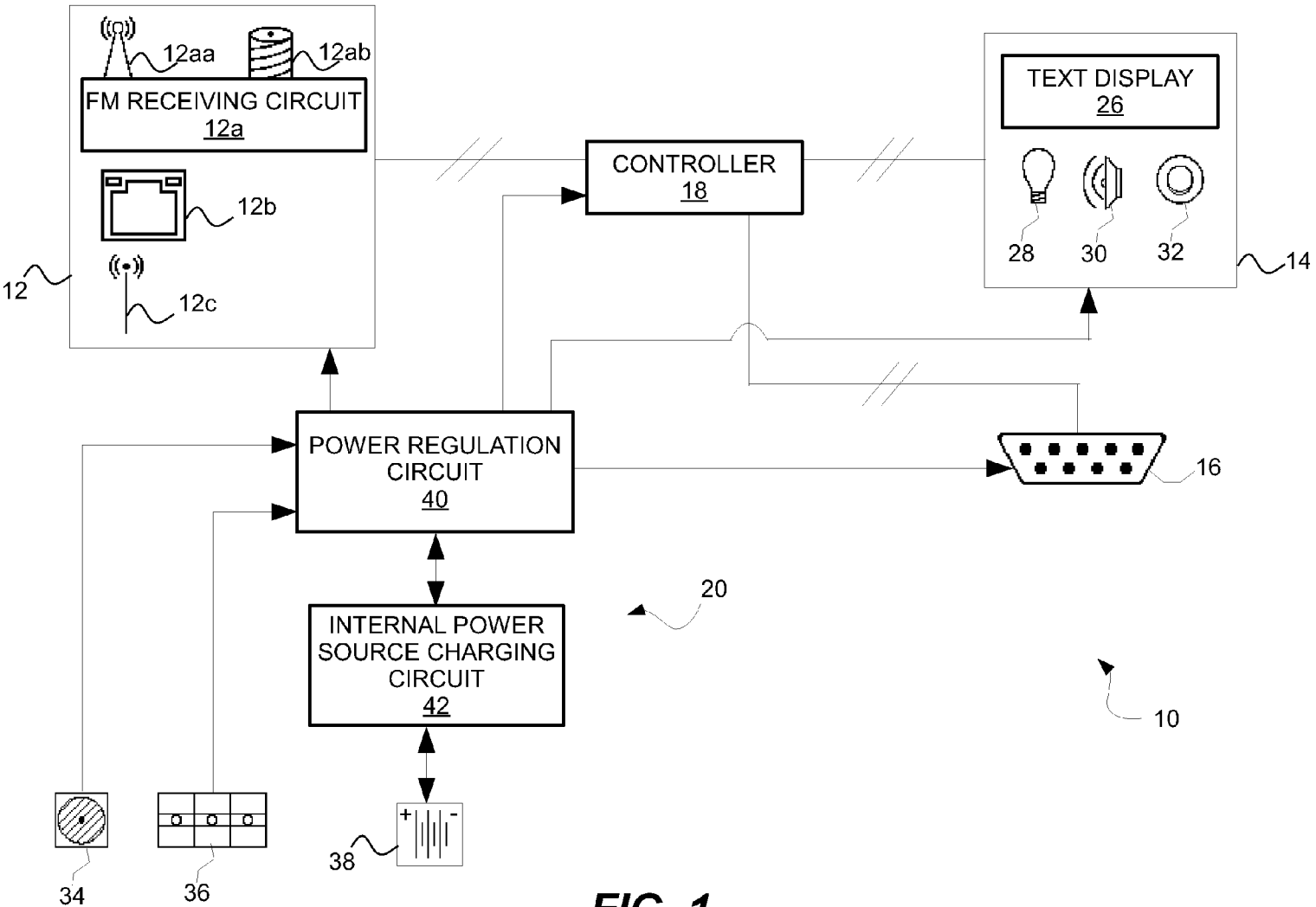
FIG. 1 is a block diagram of an exemplary alert device.

FIG. 1 provides a block-diagram of an alert device 10 according to an exemplary disclosed embodiment. Alert device 10 may include a receiving circuit 12, a user interface 14, a peripheral interface 16, a controller 18, and power circuitry 20. Alert device 10 may be generally operable to receive alert notifications, transmitted in a known format, and to generate one or more visible and/or audible alerts based on received alert notifications. Alert device 10 may be mountable on, for example, a wall, a desk, or any other location to alert people to various emergency and/or non-emergency situations. As such, alert device 10 may include a housing 22 (shown in FIGS. 2 and 3) that may generally enclose receiving circuit 12, user interface 14, peripheral interface 16, controller 18, and power circuitry 20. It should be appreciated that alert device 10 may include other components, if desired.

Receiving circuit 12 may generally include one or more receivers configured to receive alert notifications. For example, receiving circuit 12 may include an FM receiving circuit 12*a*, a wired network interface 12*b*, and a wireless network transceiver 12*c*. Although shown having three receivers, it is contemplated that receiving circuit 12 may alternatively include any number of receivers, and that receiving circuit 12 may additionally or alternatively include any other wired or wireless receivers. For example, receiving circuit 12 may include an AM radio antenna, a Bluetooth receiver, a pager transmission receiver, a Wi-MAX receiver, an HD-Radio receiver, a digital over-the-air receiver, a cable receiver, a satellite receiver, a cellular receiver, or any other receiver configured to receive data according to any other proprietary or non-proprietary communications channel. As such, it should be appreciated that alert notifications may be delivered to receiving circuit 12 over any wired or wireless communications channel using any proprietary or non-proprietary data-transfer specification. It is contemplated that receiving circuit 12 may passively await alert notification broadcasts to be received via at least one of FM receiving circuit 12*a*, wired network interface 12*b*, and wireless network transceiver 12*c*. Alternatively, alert notifications may be received by alert device 10 in response to a poll delivered by alert device 10. For example, wired network interface 12*b* and/or wireless network transceiver 12*c* may poll the alert notification system for data, the response to which may include an alert notification. In this manner, alert device 10 may be connected to a network from within, for example, a firewall and still be operable to receive alert notifications without requiring any configuration changes. It is further contemplated that wired network interface 12*b* and/or wireless network transceiver 12*c* may alternatively receive alert notifications via a push-type technology such as, for example, Internet protocol (IP) multicast.

FM receiving circuit 12*a* may include any type of antenna capable of receiving FM radio broadcasts, such as, for example, a dipole antenna. FM receiving circuit 12*a* may include an internal FM radio antenna 12*aa* and an external radio antenna connected to alert device 10 via an external radio antenna port 12*ab*. For example, external radio antenna port 12*ab* may embody a coaxial connector. It is contemplated, however, that FM receiving circuit 12*a* may include any number of internal or external antennas. It should be appreciated that FM receiving circuit 12*a* may be configured to receive any type of FM radio broadcast, such as, for example, FM radio broadcasts having one or more analog or digital subcarrier signals. For example, FM receiving circuit 12*a* may be configured to receive FM radio broadcasts having a radio data system (RDS) subcarrier and/or an HD-Radio data channel.

Wired network interface 12*b* may include any type of interface capable of receiving wired data transmissions, such as, for example, an Ethernet port. It should be appreciated that wired network interface 12*b* may additionally or alternatively connect alert device 10 to one or more computer networks, such as, for example, a local area network (LAN), an intranet, an extranet, and/or the Internet.

Wireless network transceiver 12*c* may include any type of receiver or transceiver capable of receiving wireless data transmissions, such as, for example, a Wi-Fi adapter or a Wi-MAX adapter. It should be appreciated that wireless network transceiver 12*c* may additionally or alternatively connect alert device 10 to one or more computer networks, such as, for example, a wireless local area network (WLAN), a Bluetooth network, an intranet, an extranet, and/or the Internet. It is contemplated that wireless network transceiver 12*c* may additionally or alternatively include a receiver for any other type of wireless data transmissions such as, for example, pager transmissions.

The alert notifications received by receiving circuit 12 may be transmitted by an alert notification system and may have a predetermined format (not shown). Each alert notification may generally be configured to include data indicative of how alert device 10 should respond to the alert notification, once received. More specifically, the alert notifications may include digitally encoded data that may be decoded and used by controller 18 to control alert device 10 in response to the received alert notification. For example, the data included in each alert notification may include an encoded text message, encoded instructions for at least one pattern and duration of activation of the at least one light, encoded instructions for at least one pattern and duration of activation of the at least one speaker, encoded instructions for controlling one or more external peripherals (not shown) communicatively coupled with alert device 10, and an encoded total duration of the alert notification.

It is contemplated that the encoded instructions for at least one pattern and duration of activation of the at least one speaker may alternatively or additionally include one or more single or multi-part audio files to be played over the at least one speaker. In this manner, an audio file may embody an encoded instruction for a pattern and/or duration of activation of the at least one speaker. For example, the instruction for a pattern and/or duration of activation of the at least one speaker may indicate that the audio file should be looped until the duration of activation has substantially elapsed. It is also contemplated that one or more audio files may alternatively embody a plurality of patterns and durations of activation of the at least one speaker. That is, a single audio file may include a first pattern such as, for example, a first set of spoken instructions followed by a second set of spoken instructions. In another example, a first audio file may include a first pattern to be repeated for a first duration and a second audio file may include a second pattern to be repeated for a second duration (i.e., substantially after the first duration has ended). It should be appreciated that the first audio file may be substantially the same in content as the second audio file, if desired, but that both may be included in the alert notification. It is further contemplated that the data included in the alert notifications may alternatively or additionally be encoded according to an analog encoding scheme, if desired.

The at least one pattern and duration of activation of the at least one light may, for example, include a first pattern of activation of visible alert components 28, a first duration of activation of visible alert components 28, a second pattern of activation of visible alert components 28, and a second duration of activation of visible alert components 28. Similarly, the at least one pattern and duration of activation of the at least one speaker may include a first pattern of activation of audible alert components 30, a first duration of activation of audible alert components 30, a second pattern of activation of audible alert components 30, and a second duration of activation of audible alert components 30. In this manner, the alert notification may include a first set of instructions for initially alerting people to the alert notification, and a second set of instructions for subsequently maintaining people's attention in the long-term. It should be appreciated that the patterns of activation of visible alert components 28 and audible alert components 30 may include any type of pattern, including random patterns, predefined patterns, etc., and may further include information as to the intensity and frequency of activation of visible alert components 28 and audible alert components 30, respectively. It should also be appreciated that, in this manner, the patterns and durations of activation of visible alert components 28 and audible alert components 30 may be communicated to alert device 10 via a received alert notification. That is, the patterns and durations of activation of visible alert components 28 and audible alert components 30 may be, for instance, defined based on settings chosen by a dispatcher of the alert notification.

It is contemplated that the alert notifications may further include encoded addressing information indicating which alert devices are intended recipients of the alert notifications. It should be appreciated that the addressing information may include, for example, unique identifiers of one or more alert devices, a listing of groups of alert devices (i.e., groups with which a plurality of alert devices may be associated), a geographical region (i.e., defined radially from a given latitude/longitude pair, or in any other manner known in the art), or any other classification of desired recipient alert devices (e.g., indoor devices vs. outdoor devices). It is also contemplated that the alert notifications may additionally include any other information, such as, for example, a time-stamp. It should also be appreciated that the alert notifications may be encrypted using an encryption key, and that alert device 10 may be equipped to decrypt the alert notification. In this manner, it may be difficult to falsify alert notifications.

User interface 14 may include a plurality of components generally configured to provide output to and receive input from a user of alert device 10. For example, user interface 14 may include a display 26, one or more visible alert components 28, one or more audible alert components 30, and a reset button 32. It is contemplated that user interface 14 may additionally or alternatively include any other components (e.g., buttons) operable to provide output to and receive input from a user of alert device 10, if desired.

Display 26 may embody any type of display capable of being electronically controlled to display visual messages. For example, display 26 may embody an alphanumeric liquid crystal display (LCD), or a thin-film transistor LCD (TFT LCD). It should be appreciated that display 26 may be capable of displaying any number of characters, lines of characters, characters per line, colors, and/or pixels. It should also be appreciated that display 26 may additionally be configured to display non-text elements such as, for example, images or animations. It is contemplated that display 26 may include an adjustable backlight to brighten or dim display 26, and that the backlight may be adjusted manually or programmatically (i.e., in response to an input signal such as an ambient light sensor (not shown) or a received alert notification).

Visible alert components 28 may embody any type of visible component capable of being electronically controlled to activate (i.e., turn on) and deactivate (i.e., turn off). For example, visible alert components 28 may embody one or more lights such as, for example, light emitting diodes or a strobe light. That is, although illustrated as a plurality of lights, it is contemplated that visible alert components 28 may alternatively embody a single light, if desired. An intensity level of visible alert components 28 may be electronically controllable, as is known in the art. It is contemplated that the intensity level of visible alert components 28 may be limited by a maximum intensity level, where the maximum intensity level may be chosen to maintain the readability of display 26. For example, if visible alert components 28 are activated at the maximum intensity level while display 26 is displaying a message, display 26 may be comfortably read by a user of alert device 10. More specifically, the maximum intensity level of visible alert components 28 may be chosen such that display 26 is comfortably readable by a user of alert device 10.

Audible alert components 30 may embody any type of audible component capable of being electronically controlled to activate (i.e., turn on) and deactivate (i.e., turn off). For example, audible alert components 30 may embody one or more sound-producing components such as, for example, a speaker or a siren. That is, although illustrated as a single sound-producing component, it is contemplated that audible alert components 30 may alternatively embody a plurality of sound-producing components, if desired. An intensity level of audible alert components 30 may be electronically controllable, as is known in the art. It is contemplated that the intensity level of audible alert components 30 may be limited by a maximum intensity level, where the maximum intensity level may be chosen to maintain the readability of display 26. For example, if audible alert components 30 are activated at the maximum intensity level while display 26 is displaying a message, display 26 may be comfortably read by a user of alert device 10. More specifically, the maximum intensity level of audible alert components 30 may be chosen such that alert device 10 is approachable when audible alert components 30 are activated at the maximum intensity level.

Reset button 32 may generally function to reset alert device 10. More specifically, reset button 32 may be pressed by a user of alert device to cause alert device to turn on as if it had just been powered on. It should be appreciated that reset button 32 may temporarily cut power to alert device 10 when depressed, causing alert device to "hard boot," as is known in the art. Alternatively, however, reset button 32 may simulate a cut of power to alert device 10 when depressed, causing alert device to "soft boot," as is known in the art. It should be appreciated that reset button 32 may embody any type of button. It should also be appreciated that reset button 32 may alternatively embody any other type of input device capable of operating in a manner consistent with the present disclosure. For example, reset button 32 may alternatively embody a switch, a knob, or a dial.

It is contemplated that alert device 10 may additionally include any number of other buttons or switches. For example, alert device 10 may include one or more buttons to scroll through a message displayed on display 26, manually deactivate visible alert components 28, manually deactivate audible alert components 30, or control any other operation of alert device 10. It is further contemplated that a plurality of buttons may need to be pressed in a particular order to manually deactivate visible alert components 28 and/or audible alert components 30 such that one may require knowledge of the proper sequence in order to deactivate visible alert components 28 and/or audible alert components. In this manner, an average observer of alert device 10 may be unlikely to be able to deactivate visible alert components 28 and/or audible alert components 30, and thus unlikely to prematurely end the response of alert device 10 to a received alert notification. In another example, alert device 10 may include one or more switches to set alert device 10 in a demonstration mode, disable visible alert components 28, disable audible alert components 30, or control any other setting of alert device 10.

Peripheral interface 16 may generally communicatively couple alert device 10 with one or more external peripherals such as, for example, flat-panel displays, LED marquees, text-to-speech modules, strobes, sirens, and switches (e.g., television overrides). Peripheral interface 16 may embody any type of interface suitable for communicatively coupling alert device 10 with one or more external peripherals. For example, peripheral interface may embody an RS232-compliant serial port, a relay interface, a universal serial bus (USB) port, an IEEE 1394 port, or an Ethernet port. It is contemplated that alert device 10 may additionally include a plurality of peripheral interfaces configured to communicatively couple alert device 10 with a plurality of external peripherals, if desired. Peripheral interface 16 may be operable to deliver a peripheral signal to the external peripheral to control the external peripheral. For example, the peripheral signal may include images to be displayed on a flat-panel display, a line voltage, or a data stream. It is also contemplated that an external peripheral communicatively coupled with peripheral interface 16 may alternatively or additionally deliver signals to alert device 10 via peripheral interface 16. More specifically, an external peripheral may supply an input to alert device 10 to, for example, provide feedback or data to alert device 10, or to control one or more aspects of the operation of alert device 10. For example, a panic button (not shown) may be communicatively coupled with peripheral interface 16 such that, when pressed, the panic button may deliver a signal to alert device 10, the signal indicating that an emergency situation has arisen.

Controller 18 may embody a single microprocessor or multiple microprocessors operable to control an operation of alert device 10. Controller 18 may include a memory, a secondary storage device, a processor, and any other components for running an application. Various other circuits may be associated with controller 18 such as signal conditioning circuitry, solenoid driver circuitry, and other types of circuitry.

Controller 18 may control alert device 10 in response to alert notifications received by receiving circuit 12. As such, controller 18 may be communicatively coupled with receiving circuit 12, display 26, visible alert components 28, audible alert components 30, reset button 32, peripheral interface 16. For example, controller 18 may be configured to receive alert notifications from receiving circuit 12, and decode the digitally encoded data included in the alert notifications. More specifically, controller 18 may decode the encoded text message, the encoded instructions for at least one frequency and duration of activation of the at least one light (i.e., visible alert components 28), the encoded instructions for at least one frequency and duration of activation of the at least one speaker (i.e., audible alert components 30), the encoded instructions for controlling an external peripheral, the encoded overall duration of the alert notification, and the encoded addressing information. In this manner, controller 18 may determine whether alert device 10 is an intended recipient of the alert notification, deliver the text message to display 26, control the activation and deactivation of visible alert components 28, control the activation and deactivation of audible alert components 30, and generate a peripheral signal to control the external peripheral connected to peripheral interface 16, all according to the appropriate instructions of the received alert notification. As such, it should be appreciated that controller 18 may include, stored in its memory, instructions for decoding received alert notifications, determining whether alert device 10 is an intended recipient of the alert notification, and controlling alert device 10.

Controller 18 may include, stored in its memory or secondary storage device, any information that may assist controller 18 in controlling alert device 10. For example, controller 18 may include a unique identifier of alert device 10 (e.g., an identifier provided during manufacturing of alert device 10), a listing of groups of alert devices with which alert device 10 may be associated, a geographic location of alert device 10, a listing of external peripherals connected to peripheral interface 16, a flag indicating whether alert device 10 is located indoors or outdoors, a brightness setting of display 26, and a decryption key for use in decrypting received alert notifications. It should be appreciated that the information stored in the memory or secondary storage device of controller 18, as well as any other configurable parameters of alert device 10, may be updatable via external control signals. More specifically, controller 18 may be configured to monitor receiving circuit 12 for one or more received control signals containing updated parameters of alert device 10. For example, receiving circuit 12 may receive a control signal containing an update to the listing of groups of alert devices with which alert device 10 may be associated, the geographic location of alert device 10, an update to the listing of external peripherals connected to peripheral interface 16, and/or an updated flag indicating whether alert device 10 is located indoors or outdoors. Controller 18 may receive the control signal via receiving circuit 12, and update its memory or storage device to include the updated parameters. It is contemplated that the geographic location of alert device 10 may alternatively be determined dynamically by, for example, an on-board global positioning satellite (GPS) receiver or a geographic information system (GIS). It is also contemplated that controller 18 may be configured to update any number of configurable settings of alert device 10 as indicated via received control signals. Controller 18 may also include program instructions necessary to carry out the functions of the present disclosure, as discussed below.

Power circuitry 20 may be operable to provide power to drive the components of alert device 10. For example, power circuitry 20 may be electronically connected to deliver power to FM receiving circuit 12*a*, wired network interface 12*b*, wireless network transceiver 12*c*, display 26, visible alert components 28, audible alert components 30, reset button 32, peripheral interface 16, and controller 18.

Power circuitry 20 may include one or more interfaces for receiving power from an external power source and/or one or more internal power sources. In an exemplary embodiment of the present disclosure, power circuitry 20 may include a direct current (DC) power interface 34, an alternating current (AC) power interface 36, and an internal power source 38. Power circuitry 20 may additionally include a power regulation circuit 40, and an internal power source charging circuit 42. It is contemplated that power circuitry 20 may additionally or alternatively include any number of other circuits, components, and/or interfaces that allow power circuitry 20 to operate consistent with the present disclosure, such as, for example, a power over Ethernet (PoE) module.

DC power interface 34 may include any type of jack or adaptor configured to receive DC power from an external power source. For example, DC power interface 34 may embody a coaxial power connector (i.e., a "barrel plug") jack. It should be appreciated that DC power interface 34 may be configured to receive DC power at a predetermined voltage and current, as provided by an external voltage transformer (not shown), a battery pack (not shown), a generator, or any other source of DC power. It is contemplated, however, that DC power interface 34 may alternatively be configured to receive DC power within a tolerable range of voltages and currents, and that power circuitry 20 may adjust the inputted power to obtain the voltages and currents required by the components of alert device 10. It should also be appreciated that DC power interface 34 may embody a commercially available DC power interface suitable for use consistent with the present disclosure.

AC power interface 36 may include any type of jack or adaptor configured to receive DC power from an external power source. For example, AC power interface 36 may embody a two or three wire connector plug. It should be appreciated that AC power interface 36 may be configured to receive AC power at a predetermined voltage and current, as provided by an external voltage three-prong plug, an alternator, or any other source of AC power, and that AC power interface 36 may be connected to receive AC power via any number of other components such as, for example, an AC step-down transformer. It is contemplated, however, that AC power interface 36 may alternatively be configured to receive AC power within a tolerable range of voltages and currents, and that power circuitry 20 may adjust the inputted power to obtain the voltages and currents required by the components of alert device 10. It should also be appreciated that AC power interface 36 may embody a commercially available AC power interface suitable for use consistent with the present disclosure.

Internal power source 38 may include any type of modular DC power source. For example, internal power source 38 may embody one or more batteries connected in series or a battery pack. Internal power source 38 may be rechargeable in situ. That is, when alert device 10 is connected to receive power from DC power interface 34 or AC power interface 36, internal power source 38 may be recharged by a portion of the power received therefrom. It should be appreciated that internal power source 38 may be configured to provide DC power at a predetermined voltage and current. It should also be appreciated that internal power source 38 may embody a commercially available modular DC power source suitable for use consistent with the present disclosure.

Power regulation circuit 40 may be operable to convert power from a power source to one or more voltages and currents required by the components of alert device 10. More specifically, power regulation circuit 40 may be electrically coupled with DC power interface 34, AC power interface 36, and internal power source 38 to receive power therefrom. Power regulation circuit 40 may then regulate the power received from DC power interface 34, AC power interface 36, or internal power source 38 to provide one or more predetermined DC voltages and currents to the components of alert device 10. For example, power regulation circuit 40 may filter and/or regulate the power it receives to provide the components of alert device 10 with about 3.3V DC, 5V DC, and 12V DC. As such, power regulation circuit 40 may be electrically coupled with FM receiving circuit 12*a*, wired network interface 12*b*, wireless network transceiver 12*c*, display 26, visible alert components 28, audible alert components 30, reset button 32, peripheral interface 16, and controller 18. It is contemplated that alert device 10 may alternatively include a plurality of power regulation circuits 40, if desired.

Power regulation circuit 40 may include any number of transistors, filters, regulators, resistors, capacitors, integrated circuits, or any other circuit components known in the art. It should be appreciated that many commercially available power regulation circuits may be capable of operating consistent with the present disclosure.

Internal power source charging circuit 42 may be operable to provide DC power to internal power source 38 in order to recharge internal power source 38. More specifically, internal power source charging circuit 42 may be electronically coupled with power regulation circuit 40 and internal power source 38 to receive DC power from power regulation circuit 40 and provide the power to internal power source 38. For example, internal power source charging circuit 42 may be operable in an "on" mode (i.e., when power regulation circuit 40 is receiving power from DC power interface 34 or AC power interface 36) and an "off" mode (i.e., when power regulation circuit 40 is not receiving power from DC power interface 34 or AC power interface 36). Internal power source charging circuit 42 may be operable to automatically switch between the on mode and the off mode based on, for example, a differing voltage potential, as is known in the art. When operating in the on mode, internal power source charging circuit 42 may receive DC power from power regulation circuit 40, and provide the DC power to internal power source 38 in order to recharge internal power source 38. In contrast, when operating in the off mode, internal power source charging circuit 42 may pass substantially no voltage to internal power source 38. It is contemplated that, when operating in the off mode, internal power source charging circuit 42 may be operable to provide DC power from internal power source 38 to power regulation circuit 40 (i.e., as an alternative to a direct electrical connection between internal power source 38 and power regulation circuit 40).

Internal power source charging circuit 42 may include any number of transistors, resistors, capacitors, integrated circuits, or any other circuit components known in the art. It should be appreciated that many commercially available charging circuits may be capable of operating consistent with the present disclosure. It should also be appreciated that internal power source charging circuit 42 may be configured to cut-off (i.e., pass substantially no voltage to internal power source 38) when operating in the on mode, if internal power source 38 is substantially fully charged.

Figure 2:
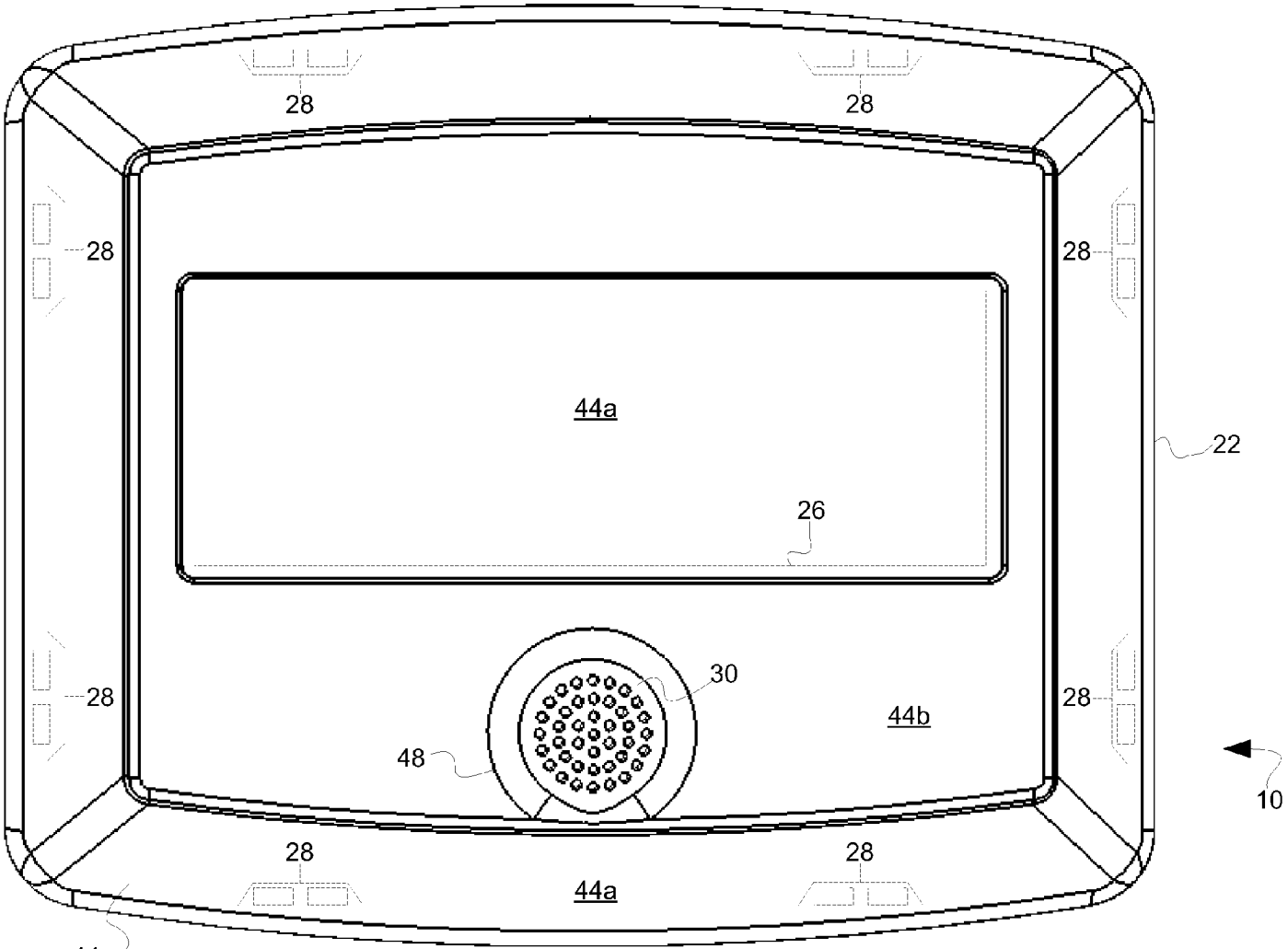
FIG. 2 is a partial diagrammatic and a partial block diagram front view of the alert device of FIG. 1.
Figure 3:
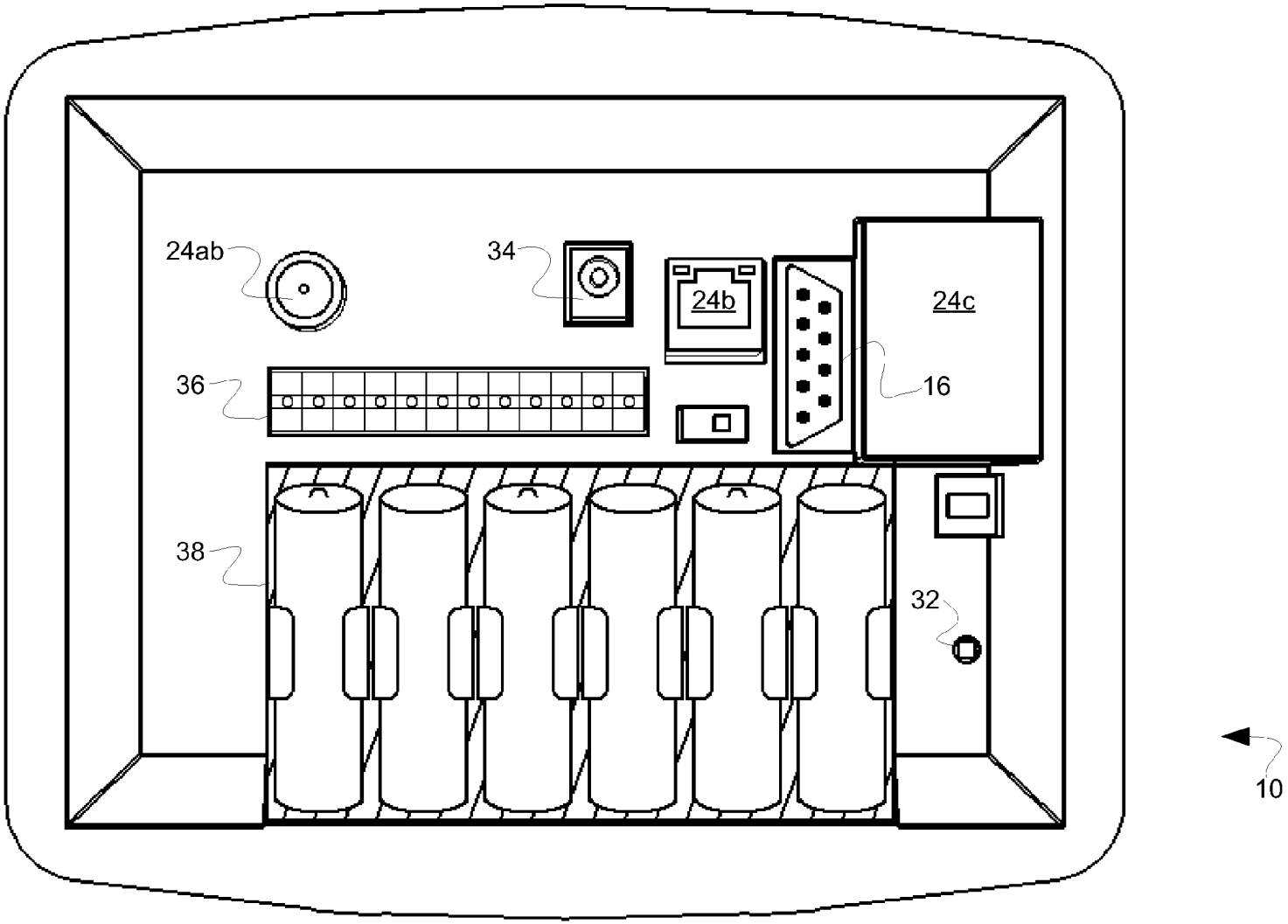
FIG. 3 is a partial diagrammatic and a partial block diagram back view of the alert device of FIG. 1.

Housing 22 of alert device 10 may substantially enclose alert device 10, and is shown in FIGS. 2-3. Housing 22 may be composed of individual housing components. More specifically, housing 22 may include a front plate 44 and a back plate 46. Front plate 44 and back plate 46 may be mutually attachable via screws, clips, or in any other manner known in the art. FIG. 2 illustrates a diagrammatic front view of alert device 10, wherein the components of alert device 10 are orientated according to an exemplary embodiment of the present disclosure. In particular, FIG. 2 illustrates display 26, visible alert components 28, and audible alert components 30, all substantially enclosed within front plate 44 of housing 22. It should be noted that, in the illustrated exemplary embodiment, visible alert components 28 are arranged circumferentially about display 26. In this manner, a viewing angle of visible alert components 28 may be maximized, while not distracting users from the message displayed on display 26. It is contemplated, however, that visible alert components 28 may be positioned in any other orientation, if desired.

Front plate 44 may generally enclose a front of alert device 10. In particular, front plate 44 may cover display 26, visible alert components 28, and audible alert components 30. In an exemplary embodiment, front plate 44 may be composed of two components. More specifically, front plate 44 may be composed of a substantially translucent component 44*a* and a substantially opaque component 44*b*. Translucent component 44*a* may cover display 26 and visible alert components 28 to protect display 26 and visible alert components 28 while allowing them to be seen clearly by a user of alert device. Opaque component 44*b* may cover audible alert components 30, and may include one or more openings 48 to allow sounds produced by audible alert components 30 to emanate from alert device 10. It should be appreciated that front plate 44 may alternatively be composed of any number of translucent and opaque components, if desired. It is contemplated that front plate 44 may include additional features such as, for example, orifices through which buttons attached to alert device 10 may be pressed.

FIG. 3 illustrates a diagrammatic back view of alert device 10, wherein the components of alert device 10 are orientated according to an exemplary embodiment of the present disclosure. In particular, FIG. 3 illustrates external radio antenna port 12*ab*, wired network interface 12*b*, wireless network transceiver 12*c*, reset button 32, peripheral interface 16, DC power interface 34, AC power interface 36, and internal power source 38, all substantially enclosed within back plate 46 of housing 22.

Back plate 46 may generally enclose a back of alert device 10. In particular, back plate 46 may cover external radio antenna port 12*ab*, wired network interface 12*b*, wireless network transceiver 12*c*, reset button 32, peripheral interface 16, DC power interface 34, AC power interface 36, and internal power source 38. Back plate 46 may include one or more portholes to allow a user access to one or more components of alert device 10. In an exemplary embodiment of the present disclosure, back plate 46 may include a plurality of portholes allowing access to external radio antenna port 12*ab*, wired network interface 12*b*, reset button 32, peripheral interface 16, DC power interface 34, AC power interface 36, and internal power source 38. In this manner, connections may be made to external radio antenna port 12*ab*, wired network interface 12*b*, peripheral interface 16, DC power interface 34, and AC power interface 36. Similarly, a user of alert device 10 may have access to reset button 32 in order to press reset button 32, and internal power source 38 in order to, for example, install or replace internal power source 38.

An exemplary operation of alert device 10 will now be discussed with regard to FIG. 4.

INDUSTRIAL APPLICABILITY

The disclosed alert device may generally be operable to receive alert notifications, decode the alert notifications, and activate audible and visible alert components according to instructions provided by the alert notifications. More specifically, the disclosed alert device may be applicable to receive emergency alert notifications and non-emergency alert notifications. Emergency alert notifications may indicate an emergency situation at or near the alert device, such as, for example, a tornado, a biohazard, an active shooter, a fire, and any other type of emergency situation. Non-emergency alert notifications may indicate a non-emergency situation or information that may be of interest to users of the disclosed alert device, such as, for example, inclement weather alerts and any other type of non-emergency situation or information. Because the disclosed alert device may be operable to display text and utilize visible and/or audible alert components to attract people's attention, the disclosed alert device may be applicable in any situation in which information must be conveyed to one or more persons.

As discussed above with reference to FIG. 3, the components of alert device 10 may generally be driven by regulated DC power. More specifically, power regulation circuit 40 may receive power from an external power source via DC power interface 34 or AC power interface 36, or from internal power source 38. Power regulation circuit 40 may then filter and regulate the received power, as is known in the art, to provide one or more predetermined DC voltages and/or currents. In an exemplary embodiment, power regulation circuit 40 may provide DC power at about 3.3V, 5V, and 12V. The power provided by power regulation circuit 40 may be directed to FM receiving circuit 12*a*, wired network interface 12*b*, wireless network transceiver 12*c*, display 26, visible alert components 28, audible alert components 30, reset button 32, peripheral interface 16, and controller 18.

Internal power source charging circuit 42 may detect whether power is being provided to power regulation circuit 40 via one of DC power interface 34 and AC power interface 36, and switch to the on mode when power is being provided via one of DC power interface 34 and AC power interface 36. It should be appreciated that internal power source charging circuit 42 may switch to the on mode when it detects that power regulation circuit 40 is receiving power from any power source other than internal power source 38 (e.g., when power regulation circuit 40 is receiving power from a PoE source). Substantially after switching to the on mode, internal power source charging circuit 42 may receive DC power at a predetermined voltage and/or current from power regulation circuit 40, and provide the DC power to internal power source 38 to charge internal power source 38. For example, power regulation circuit 40 may provide internal power source charging circuit 42 with about 9.0V of DC power to charge internal power source 38. It should be appreciated that internal power source charging circuit 42 may charge internal power source 38 while power regulation circuit 40 provides DC power to the components of alert device 10. When powered, the components of alert device 10 may function according to the exemplary operation depicted in FIG. 4.

Figure 4:
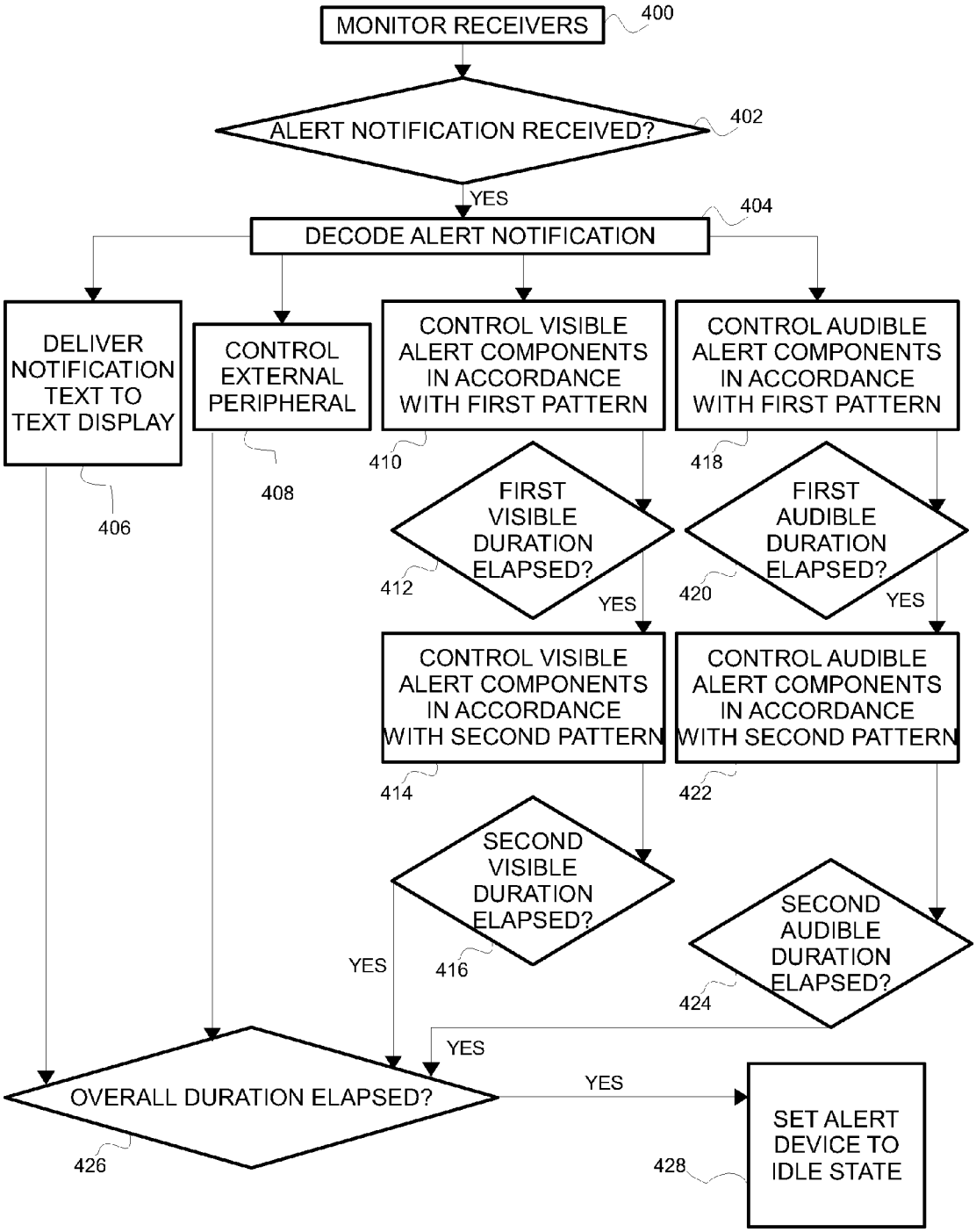
FIG. 4 is a flowchart illustrating an exemplary method of operation of the alert device of FIG. 1.

With reference to the flowchart of FIG. 4, controller 18 may control the operation of alert device 10. More specifically, controller 18 may monitor receiving circuit 12 for an alert notification (Step 400) and determine when an alert notification is received (Step 402). Once an alert notification is received, controller 18 may decode the alert notification (Step 404). Controller 18 may then use the decoded contents of the alert notification to deliver the text message to display 26 (Step 406), control an external peripheral via peripheral interface 16 (Step 408), control activation and deactivation of visible alert components 28 (Steps 410-416), and control activation and deactivation of audible alert components 30 (Steps 418-424). Controller 18 may determine whether the overall duration of the alert notification has elapsed (Step 426), and set alert device 10 to an idle state (i.e., deactivate visible alert components 28 and audible alert components 30, and display an idle message on display 26) once it determines that the overall duration has elapsed (Step 428). It is contemplated that steps 400-428 may be carried out substantially simultaneously by controller 18 (e.g., using any parallel processing technique known in the art). For example, controller 18 may receive a first alert notification and proceed to carry out Steps 404-428. Substantially simultaneously, however, controller 18 may continue to monitor receiving circuit 12 for a second alert notification (Step 400). Similarly, controller 18 may check whether the overall duration has elapsed (Step 426) periodically and substantially simultaneous with any of Steps 400-424.

During operation of alert device 10, controller 18 may monitor receiving circuit 12 (Step 400). More specifically, alert device 10 may be configured to receive alert notifications via at least one of FM receiving circuit 12*a*, wired network interface 12*b*, and wireless network transceiver 12*c*. In one example, alert device 10 may be configured to receive FM transmissions via internal FM radio antenna 12*aa*. Alternatively or additionally, alert device 10 may be connected to an external FM radio antenna via external radio antenna port 12*ab*, which may substantially enhance the reception capabilities of alert device 10 with respect to FM transmissions (i.e., when compared to using internal FM radio antenna 12*aa* without an external FM radio antenna to receive FM transmissions). In another example, alert device 10 may be connected to a LAN via wired network interface 12*b*, and configured to receive alert notifications transmitted via the LAN. In yet another example, alert device 10 may be connected to a WLAN via wireless network transceiver 12*c*. It should be appreciated that any steps necessary to connect alert device 10 to a secured network (i.e., a firewalled network, a password-protected network, a security key-enabled network, etc.) may be taken by, for example, an administrator of the network, such that alert device 10 may receive data from the network. It should also be appreciated that alert device 10 may be configured to receive alert notifications over a predetermined port number, as is known in the art.

Transmissions received by alert device 10 may be communicated (i.e., by FM receiving circuit 12*a*, wired network interface 12*b*, and/or wireless network transceiver 12*c*) to controller 18. It is contemplated that, when controller 18 is not handling an alert notification, alert device 10 may be in an idle state. When in the idle state, controller 18 may deliver one or more idle messages to display 26, such as, for example, text indicating that no alert notifications are active for alert device 10, or the current time and date. As discussed above, alert notifications may be received by receiving circuit 12 in any way known in the art. For example, receiving circuit 12 may receive alert notifications via an alert notification broadcast, in response to a poll delivered by alert device 10, or via a push-type technology such as, for example, Internet protocol (IP) multicast.

Controller 18 may then determine whether or not alert device 10 has received an alert notification (Step 402). More specifically, controller 18 may check a received transmission to determine if the transmission is that of an alert notification and if the transmission is intended for receipt by alert device 10. For example, controller 18 may use the decryption key stored in its memory to decrypt the transmission, and check the decrypted transmission for addressing information. Controller 18 may then compare the addressing information to the addressing information stored in its memory (as discussed above) in order to determine whether the alert notification is intended for receipt by alert device 10. More specifically, controller 18 may check the addressing data to determine whether the transmission is addressed to alert device 10, a geographical region that includes alert device 10, a general location of alert device 10 (i.e., indoors or outdoors), or a group to which alert device 10 has been assigned, as discussed above. If controller 18 determines that the received transmission is not that of an alert notification and/or is not intended for alert device 10, controller 18 may return to Step 400 to monitor receiving circuit 12.

In contrast, if controller 18 determines that the received transmission is that of an alert notification and it is intended for alert device 10, controller 18 may then decode the alert notification (Step 404). More specifically, controller 18 may decode the alert notification to determine the text message, instructions for at least one pattern and duration of activation of the at least one light, instructions for at least one pattern and duration of activation of the at least one speaker, instructions for controlling an external peripheral, and overall duration of the alert notification. In one exemplary embodiment, and continuing the above example, the at least one pattern and duration of activation of the at least one light may include a first pattern of activation of visible alert components 28, a first duration of activation of visible alert components 28, a second pattern of activation of visible alert components 28, and a second duration of activation of visible alert components 28. Similarly, the at least one pattern and duration of activation of the at least one speaker may include a first pattern of activation of audible alert components 30, a first duration of activation of audible alert components 30, a second pattern of activation of audible alert components 30, and a second duration of activation of audible alert components 30.

Controller 18 may deliver the text message to display 26 (Step 406). In this manner, display 26 may display the text message. Because display 26 may be capable of displaying a maximum number of characters at a time, controller 18 may control display 26 to display the text message in parts. That is, the text message may contain more characters than display 26 can display at a given time, and, in this case, controller 18 may deliver the text message to display 26 in portions that are short enough to be displayed at one time on display 26. Controller 18 may control display 26 to appear to scroll through the text message, either continuously, or as blocks of text displayed for a predetermined period of time. For example, if display 26 can display forty characters at one time and the notification message is sixty characters long, controller 18 may deliver the first forty or fewer characters of the text message to display 26 for about ten seconds, then deliver the remaining characters of the text message to display 26 for about another ten seconds before repeating the text message. It is contemplated that display 26 may additionally include one or more logic components configured to split text messages that are longer than a maximum length of display 26.

Controller 18 may control an external peripheral via peripheral interface 16 (Step 408). More specifically, controller 18 may use the instructions for controlling the external peripheral to generate a peripheral signal and pass the peripheral signal to peripheral interface 16 to control the external peripheral as indicated. In this manner, the external peripheral may be used to, for example, display an alert message, or activate one or more attention-getting visible or audible components. In one example, the external peripheral may be flat-panel display and the peripheral signal generated by controller 18 may control the flat-panel display to show an alert screen containing the text message. It should be appreciated that alert device 10 may not be connected to an external peripheral and/or the alert notification may not include instructions for controlling the external peripheral. In these cases, controller 18 may omit Step 408.

Controller 18 may also control visible alert components 28 in accordance with the first pattern of activation of visible alert components 28, as indicated by the alert notification (Step 410). For example, the first pattern of activation of visible alert components 28 may include flashing the lights of visible alert components 28 substantially simultaneously twice for two seconds at one second intervals (i.e., activate visible alert components 28 a first time for less than one second, activate visible alert components 28 a second time for less than one second, deactivate visible alert components 28 for one second, and repeat). It should be appreciated that the alert notification may specify any first pattern of activation of visible alert components 28, and that the above pattern is presented as an example only.

Controller 18 may continue to control visible alert components 28 in accordance with the first pattern of activation of visible alert components 28 until controller 18 has determined that the first duration of activation of visible alert components 28 has elapsed (Step 412). More specifically, controller 18 may utilize its clock to determine whether the first duration of activation of visible alert components 28 has elapsed since the alert notification was received by controller 18. For example, the first duration of activation may be three minutes. It should be appreciated, however, that the alert notification may specify any first duration of activation of visible alert components 28, and that the above duration is presented as an example only. Once this duration has substantially elapsed, controller 18 may change the behavior of visible alert components 28.

More specifically, controller 18 may then control visible alert components 28 in accordance with the second pattern of activation of visible alert components 28 (Step 414). For example, the second pattern of activation of visible alert components 28 may include individually activating each light of visible alert components 28 consecutively in a clockwise direction three times, then pausing for five seconds before repeating the pattern. It should be appreciated that the alert notification may specify any second pattern of activation of visible alert components 28, and that the above pattern is presented as an example only.

Controller 18 may continue to control visible alert components 28 in accordance with the second pattern of activation of visible alert components 28 until controller 18 has determined that the second duration of activation of visible alert components 28 has elapsed (Step 416). More specifically, controller 18 may utilize its clock to determine whether the second duration of activation of visible alert components 28 has elapsed since the first duration of activation of visible alert components 28 was determined to have elapsed. For example, the second duration of activation may be seventeen minutes. It should be appreciated, however, that the alert notification may specify any second duration of activation of visible alert components 28, and that the above duration is presented as an example only. Once this duration has substantially elapsed, controller 18 may change the behavior of visible alert components 28. For example, once the second duration of activation of visible alert components 28 has substantially elapsed, controller 18 may deactivate visible alert components 28.

Controller 18 may further control audible alert components 30 in accordance with the first pattern of activation of audible alert components 30 (Step 418). For example, the first pattern of activation of audible alert components 30 may include producing a high-intensity sound for one second at nine second intervals (i.e., activate the sound for one second, deactivate the sound for nine seconds, and repeat). It should be appreciated that the alert notification may specify any first pattern of activation of audible alert components 30, and that the above pattern is presented as an example only.

Controller 18 may continue to control audible alert components 30 in accordance with the first pattern of activation of audible alert components 30 until controller 18 has determined that the first duration of activation of audible alert components 30 has elapsed (Step 420). More specifically, controller 18 may utilize its clock to determine whether the first duration of activation of audible alert components 30 has elapsed since the alert notification was received by controller 18. For example, the first duration of activation may be three minutes. It should be appreciated, however, that the alert notification may specify any first duration of activation of audible alert components 30, and that the above duration is presented as an example only. Once this duration has substantially elapsed, controller 18 may change the behavior of audible alert components 30.

More specifically, controller 18 may then control audible alert components 30 in accordance with the second pattern of activation of audible alert components 30 (Step 422). For example, the second pattern of activation of audible alert components 30 may include producing three short low-intensity sounds (e.g., beeps) consecutively at thirty second intervals (i.e., activate the sound three times consecutively, deactivate the sound for thirty seconds, and repeat). It should be appreciated that the alert notification may specify any second pattern of activation of audible alert components 28, and that the above pattern is presented as an example only.

Controller 18 may continue to control audible alert components 30 in accordance with the second pattern of activation of audible alert components 30 until controller 18 has determined that the second duration of activation of audible alert components 30 has elapsed (Step 424). More specifically, controller 18 may utilize its clock to determine whether the second duration of activation of audible alert components 30 has elapsed since the first duration of activation of audible alert components 30 was determined to have elapsed. For example, the second duration of activation may be seventeen minutes. It should be appreciated, however, that the alert notification may specify any second duration of activation of audible alert components 30, and that the above duration is presented as an example only. Once this duration has substantially elapsed, controller 18 may change the behavior of audible alert components 30. For example, once the second duration of activation of audible alert components 30 has substantially elapsed, controller 18 may deactivate audible alert components 30.

Controller 18 may generally continue to control display 26, the external peripheral connected to peripheral interface 16, visible alert components 28, and audible alert components 30 as described above until the overall duration of the alert notification has substantially elapsed (Step 426). More specifically, controller 18 may utilize its clock to determine whether the overall duration of the alert notification has elapsed since the alert notification was received by controller 18. For example, the overall duration of the alert notification may be twenty minutes. It should be appreciated, however, that the alert notification may specify any overall duration, and that the above duration is presented as an example only. It is contemplated that controller 18 may alternatively continue to control display 26, the external peripheral connected to peripheral interface 16, visible alert components 28, and audible alert components 30 as described above until the alert notification is no longer being transmitted, if desired. For example, controller 18 may continue to send polling messages to the alert notification system via receiving circuit 12 substantially simultaneously with Steps 404-426, and the alert notification system may continue to respond by transmitting the alert notification to alert device 10 until the overall duration substantially elapses. In this manner, controller 18 may cease controlling display 26, the external peripheral connected to peripheral interface 16, visible alert components 28, and audible alert components 30 as indicated by the alert notification when controller 18 no longer receives the alert notification. It should be appreciated that alert device 10 may alternatively receive the alert notification via a broadcast, and that controller 18 may cease controlling display 26, the external peripheral connected to peripheral interface 16, visible alert components 28, and audible alert components 30 as indicated by the alert notification when controller 18 no longer receives the alert notification via a broadcast.

Once the overall duration of the alert notification has substantially elapsed, controller 18 may proceed to since to set alert device 10 to the idle state (Step 428). More specifically, controller 18 may stop delivering the text message to display 26, stop controlling the external peripheral connected via peripheral interface 16, deactivate visible alert components 28, and deactivate audible alert components 30. It should be appreciated that, when in the idle state, controller 18 may deliver one or more idle messages to display 26, such as, for example, text indicating that no alert notifications are active in the beacon, or the time and date.

As discussed above, controller 18 may continue to monitor receiving circuit 12 for a newer alert notification (i.e., a second alert notification) while carrying out Steps 404-428 with respect to the received alert notification (i.e., the first alert notification). It is contemplated that, upon receiving a second alert notification, controller 18 may proceed to carry out steps 404-428 with respect to the second alert notification, regardless of the current steps being executed with respect to the first received alert notification (i.e., the second alert notification may clobber the first alert notification).

The disclosed system and method for presenting alerts to people may provide a flexible alert device capable of being used to effectively alert people to a maximized variety of situations and information. More specifically, because the disclosed alert device may be dynamically instructed as to how an alert notification should be handled (i.e., the alert notification itself may include instructions as to how the components of the alert device should be activated to alert people of the alert notification), the alert device may be capable of effectively displaying alerts of differing emergency levels. In this manner, people viewing the alerts may be able to easily discern between an emergency situation, a non-emergency situation, and generally useful information. Further, because the instructions as to how the alert device should handle the alert notification may be included in the alert notification, and because the instructions for activation of audible components may be defined independently of the instructions for activation of visible components, the alert device may be capable of utilizing many different alert techniques (i.e., the types and durations of visible and audible alerts, and/or the duration of the displayed message text, as well as combinations of types of visible alerts and types of audible alerts) without reprogramming or modifying the alert device. The total number of alert techniques that the disclosed alert device may be capable of utilizing may be limited only by the total number of permutations of instructions deliverable to the alert device via alert notifications.

The disclosed system and method for presenting alerts to people may further provide a versatile alert device. More specifically, because the disclosed alert device may alert people by activating a first audible alert pattern and a first visible alert pattern followed by at least a second audible alert pattern and second visible alert pattern, respectively, the alert device may function to efficiently attract the attention of people while allowing them to comfortably approach the alert device to effectively convey information about the indicated situation. That is, the first (i.e., initial) alert routines may include attention-getting techniques such as, for example, flashing the visible alert components and playing a high-intensity sound over the audible alert components. Substantially immediately after the first alert routines, the alert device may begin the second (i.e., subsequent) alert routines including an attention-maintaining technique such as, for example, slowly pulsing the visible alert components and playing a low-intensity sound over the audible alert components. In this manner, the alert device may initially attract the attention of people, thus informing them that a situation exists, and subsequently allow the people to comfortably approach the alert device to read the notification message (i.e., learn about the type of situation, actions that should be taken, etc.).

The disclosed system and method for presenting alerts to people may also provide a flexible alert system. More specifically, because the disclosed alert device may be connected to one or more external peripherals, and because the instructions to activate those external peripherals may be included in an alert notification on a case-by-case basis, the disclosed alert device may have maximized flexibility in alerting capabilities. That is, in addition to the display and audible and visible alert components of the alert device, received alert notifications can further signal the activation of external devices affording further and different methods of alerting people, which may aid in the effectiveness of alerting people during various situations including emergency situations. Further, because these external peripherals may be activated based on dedicated instructions included in the alert notification, dispatchers of the alert notification may be able to activate specific external peripherals when desired and not otherwise, thus allowing for complete customization of the alert techniques executed in response to each alert notification dispatched (i.e., with regard to external peripherals). For example, the external peripheral may be a loud speaker connected to play a recorded message instructing people to evacuate a building. In the event of a fire, an alert notification indicating an emergency situation may be transmitted to the disclosed alert device. The dispatcher may choose to include an instruction in the alert notification indicating the activation of the recorded message, indicating to people that they should evacuate the building. However, in the event of a tornado, a similar alert notification indicating an emergency situation may be transmitted to the disclosed alert device. The dispatcher may choose not to include an instruction in the alert notification indicating the activation of the recorded message, as it may be dangerous to instruct people to evacuate the building. In both cases, people may be alerted of an emergency situation, and in both cases, the people may be directed toward safety by similar alert notifications, the primary difference of which may be the activation of lack of activation of the external peripheral.

The disclosed system and method may be still further efficient due to its method of deactivation. That is, because the disclosed alert device may generally be deactivated only after a chosen overall duration has elapsed, the alert device may perform to the desired expectation of the alert notification dispatchers. More specifically, because the alert notification dispatchers may specify the overall duration of the alert notification, and because the disclosed alert device may be difficult to deactivate (i.e., a particular button sequence may be needed to deactivate the alert device prematurely), the alert notification dispatchers may be confident that the alert notification will last substantially as long as they intended. In this manner, the alert notification dispatchers may choose an overall duration appropriate to each alert situation.

It will be apparent to those skilled in the art that various modifications and variations can be made in the system and method of the present disclosure without departing from the scope of the invention. Other embodiments may be apparent to those skilled in the art from consideration of the specification and practice of the system and method disclosed herein. It is intended that the specification and examples be considered as exemplary only, with a true scope being indicated by the following claims and their equivalents.

What is claimed is:

1. An alert device, comprising:

a light configured to controllably activate and deactivate;

a speaker configured to controllably activate and deactivate;

a communication system having at least one receiver configured to receive an alert notification containing at least digitally encoded instructions for at least one pattern and duration of activation of the light, digitally encoded instructions for at least one pattern and duration of activation of the speaker, and digitally encoded instructions for an overall duration of the alert notification; and a controller communicatively coupled with the light, the speaker, and the communication system, wherein the controller is configured to:

monitor the communication system for the alert notification;

decode the alert notification to determine the at least one pattern and duration of activation of the light, the at least one pattern and duration of activation of the speaker, and the overall duration of the alert notification;

activate the light for the at least one pattern and duration of activation of the light;

activate the speaker for the at least one pattern and duration of activation of the speaker; and deactivate the light and the speaker after the overall duration of the alert notification substantially elapses.

2. The alert device of claim 1, further including a display communicatively coupled with the controller.

3. The alert device of claim 2, wherein:

the alert notification further includes digitally encoded instructions for a text message; and the controller is further configured to:

decode the alert notification to determine the text message;

display the text message on the display; and stop displaying the text message on the display when the overall duration of the alert notification substantially elapses.

4. The alert device of claim 1, wherein:

the alert notification is a first alert notification;

the communication system is further configured to receive a second alert notification, where the second alert notification is different from the first alert notification; and the controller is further configured to:

monitor the communication system for the second alert notification; and deactivate the at least one light and the at least one speaker substantially when the second alert notification is received.

5. The alert device of claim 1, wherein the receiver includes at least one of an FM receiving circuit, a wireless network transceiver, and a local area network adaptor.

6. The alert device of claim 1, further including a peripheral interface communicatively coupled with the controller and an external peripheral, wherein the controller is further configured to:

generate a peripheral signal to control the external peripheral; and send the peripheral signal to the peripheral interface.

7. The alert device of claim 6, wherein:

the alert notification further includes digitally encoded instructions for controlling the external peripheral;

the controller is further configured to decode the alert notification to determine the instructions for controlling the external peripheral; and the peripheral signal is generated based on the instructions for controlling the external peripheral.

8. The alert device of claim 6, wherein the peripheral interface includes at least a serial port.

9. The alert device of claim 1, wherein:

the at least one pattern and duration of activation of the at least one light includes:

a first pattern of activation of the light;

a second pattern of activation of the light;

a first duration of activation of the light; and a second duration of activation of the light; and the controller is further configured to:

activate the light according to the first pattern of activation of the light for at least the first duration of activation of the light; and activate the light according to the second pattern of activation of the light for at least the second duration of activation of the light.

10. The alert device of claim 1, wherein:

the at least one pattern and duration of activation of the at least one speaker includes:

a first pattern of activation of the speaker;

a second pattern of activation of the speaker;

a first duration of activation of the speaker; and a second duration of activation of the speaker; and the controller is further configured to:

activate the speaker according to the first pattern of activation of the speaker for at least the first duration of activation of the speaker; and activate the speaker according to the second pattern of activation of the speaker for at least the second duration of activation of the speaker.

11. The alert device of claim 1, wherein the at least one receiver is further configured to receive instructions for at least one of configuring the alert device to recognize at least one external peripheral communicatively coupled with the alert the device, configuring the alert device to identify itself as being indoors, configuring the alert device to identify itself as being outdoors, configuring the alert device to identify itself as being a member of at least one group of alert devices, and configuring the alert device to store a location of the alert device.

12. The alert device of claim 1, wherein the alert notification is received via an alert notification broadcast.

13. The alert device of claim 1, wherein:

the receiver is a transceiver configured to transmit a plurality of polling messages to an alert notification system; and the alert notification is received via a response to at least one of the plurality of polling messages.

14. A method of controlling an alert device having at least one light and at least one speaker, the method comprising:

receiving an alert notification including instructions for at least one pattern and duration of activation of the at least one light, instructions for at least one pattern and duration of activation of the at least one speaker, and instructions for an overall duration of the alert notification;

decoding the alert notification to determine the at least one pattern and duration of activation of the at least one light, the at least one pattern and duration of activation of the at least one speaker, and the overall duration of the alert notification;

activating the at least one light for the at least one pattern and duration of activation of the at least one light;

activating the at least one speaker for the at least one pattern and duration of activation of the at least one speaker; and deactivating the at least one light and the at least one speaker after the overall duration of the alert notification substantially elapses.

15. The method of claim 14, wherein the alert notification further includes instructions for a text message, the method further including:

decoding the alert notification to determine the text message;

displaying the text message; and ceasing to display the text message when the overall duration of the alert notification substantially elapses.

16. The method of claim 14, wherein the alert notification is a first alert notification, and the method further includes:

receiving a second alert notification, where the second alert notification is different from the first alert notification; and deactivating the at least one light and the at least one speaker substantially when the second alert notification is received.

17. The method of claim 14, further including monitoring at least one of an FM radio frequency, an AM radio frequency, a wireless network traffic, and a local area network traffic, wherein the alert notification is received via at least one of the monitored FM radio frequency, AM radio frequency, wireless network traffic, and local area network traffic.

18. The method of claim 14, further including:

generating a peripheral signal to control an external peripheral; and delivering the peripheral signal to the external peripheral.

19. The method of claim 18, wherein the alert notification further includes instructions for controlling the external peripheral, and the method further includes:

decoding the alert notification to determine the instructions for controlling the external peripheral, wherein the peripheral signal is generated based on the instructions for controlling the external peripheral.

20. The method of claim 14, wherein:

the at least one pattern and duration of activation of the at least one light includes:

a first pattern of activation of the at least one light;

a second pattern of activation of the at least one light;

a first duration of activation of the at least one light; and a second duration of activation of the at least one light; and the method further includes:

activating the at least one light according to the first pattern of activation of the at least one light for at least the first duration of activation of the at least one light; and activating the at least one light according to the second pattern of activation of the at least one light for at least the second duration of activation of the at least one light.

21. The method of claim 14, wherein:

the at least one pattern and duration of activation of the at least one speaker includes:

a first pattern of activation of the at least one speaker;

a second pattern of activation of the at least one speaker;

a first duration of activation of the at least one speaker; and a second duration of activation of the at least one speaker; and the method further includes:

activating the at least one speaker according to the first pattern of activation of the at least one speaker for at least the first duration of activation of the at least one speaker; and activating the at least one speaker according to the second pattern of activation of the at least one speaker for at least the second duration of activation of the at least one speaker.

22. The method of claim 14, further including receiving instructions for at least one of configuring the alert device to recognize at least one external peripheral communicatively coupled with the alert the device, configuring the alert device to identify itself as being indoors, configuring the alert device to identify itself as being outdoors, configuring the alert device to identify itself as being a member of at least one group of alert devices, and configuring the alert device to store a location of the alert device.

23. An alert device, comprising:

at least one light configured to controllably activate and deactivate;

at least one speaker configured to controllably activate and deactivate;

a communication system having at least one receiver configured to receive an alert notification; and a controller communicatively coupled with the at least one light, the at least one speaker, and the communication system, wherein the controller is configured to:

monitor the communication system for the alert notification;

activate the at least one light according to a first pattern of activation of the at least one light for at least a first duration of activation of the at least one light;

activate the at least one light according to a second pattern of activation of the at least one light for at least a second duration of activation of the at least one light;

activate the at least one speaker according to a first pattern of activation of the at least one speaker for at least a first duration of activation of the at least one speaker; and activate the at least one speaker according to a second pattern of activation of the at least one speaker for at least a second duration of activation of the at least one speaker.

24. A method of controlling an alert device having at least one light and at least one speaker, the method comprising:

receiving an alert notification;

activating the at least one light according to a first pattern of activation of the at least one light for at least a first duration of activation of the at least one light;

activating the at least one light according to a second pattern of activation of the at least one light for at least a second duration of activation of the at least one light;

activating the at least one speaker according to a first pattern of activation of the at least one speaker for at least a first duration of activation of the at least one speaker; and activating the at least one speaker according to a second pattern of activation of the at least one speaker for at least a second duration of activation of the at least one speaker.

25. An alert device, comprising:

a display;

at least one light configured to controllably activate and deactivate;

at least one speaker configured to controllably activate and deactivate;

a serial port communicatively coupled with an external peripheral;

a communication system having at least one receiver configured to receive:

a first alert notification containing at least digitally encoded instructions for a text message, digitally encoded instructions for at least one pattern and duration of activation of the at least one light, digitally encoded instructions for at least one pattern and duration of activation of the at least one speaker, digitally encoded instructions for controlling the external peripheral, and digitally encoded instructions for an overall duration of the alert notification; and a second alert notification; and a controller communicatively coupled with the display, the at least one light, the at least one speaker, the serial port, and the communication system, wherein the controller is configured to:

monitor the communication system for the first alert notification;

monitor the communication system for the second alert notification;

decode the first alert notification to determine the text message, the at least one pattern and duration of activation of the at least one light, the at least one pattern and duration of activation of the at least one speaker, the instructions for controlling the external peripheral, and the overall duration of the alert notification;

display the text message on the display;

activate the at least one light for the at least one pattern and duration of activation of the at least one light;

activate the at least one speaker for the at least one pattern and duration of activation of the at least one speaker;

generate a peripheral signal to control the external peripheral, wherein the peripheral signal is based on the instructions for controlling the external peripheral;

deliver the peripheral signal to the serial port;

deactivate the display, the at least one light, and the at least one speaker when the overall duration of the alert notification substantially elapses; and deactivate the display, the at least one light, and the at least one speaker when the second alert notification is substantially received.

26. The alert device of claim 25, wherein the at least one light includes a plurality of lights arranged circumferentially about the display.

* * * * *